US005383572A

United States Patent [19]

Mrajca

[11] Patent Number: 5,383,572

[45] Date of Patent: Jan. 24, 1995

[54] CARD COUNTER AND DISPENSER

[76] Inventor: Ted Mrajca, 416 Elm Road, Toronto, Ontario, Canada, M5M 3W5

[21] Appl. No.: 130,337

[22] Filed: Oct. 1, 1993

[51] Int. Cl.[6] ..... B65G 59/06; B65H 3/06

[52] U.S. Cl. ..... 221/259; 221/6; 221/14; 221/177; 221/188; 221/277; 221/304; 271/121; 271/124

[58] Field of Search ..... 221/259, 277, 2, 6, 221/7, 8, 13, 14, 18, 176, 177, 188, 189, 206, 207, 304, 311, 312 R, 193, 195; 271/121, 124, 182

[56] References Cited

U.S. PATENT DOCUMENTS

| | | | |
|---|---|---|---|
| 1,292,619 | 1/1919 | Lorenz | 221/18 |
| 3,151,863 | 10/1964 | Lohr | 271/121 |
| 3,790,161 | 2/1974 | Ericsson | 221/197 X |
| 3,849,968 | 11/1974 | Tateisi | 221/13 X |
| 3,887,106 | 6/1975 | Charlson et al. | 221/259 X |
| 4,039,181 | 8/1977 | Prewer | 221/259 X |
| 4,717,043 | 1/1988 | Groover et al. | 221/7 |
| 4,982,337 | 1/1991 | Burr et al. | 221/7 X |
| 4,982,412 | 1/1991 | Gross | 222/2 X |
| 5,018,614 | 5/1991 | Ruckert | 221/259 X |
| 5,078,381 | 1/1992 | Brabant et al. | 271/124 X |

FOREIGN PATENT DOCUMENTS

| | | | |
|---|---|---|---|
| 659146 | 12/1986 | Switzerland | 221/304 X |

*Primary Examiner*—Robert P. Olszewski
*Assistant Examiner*—Dean A. Reichard
*Attorney, Agent, or Firm*—Kenneth M. Garrett

[57] ABSTRACT

A low cost high speed counter and dispenser of tickets includes a feed roll and a hopper for feeding cards tangentially onto the feed roll. A pair of nip rolls rotating at a higher peripheral speed than the feed roll opens a gap between the trailing edge of one ticket and the leading edge of the next ticket that is detected by a photodetector cell providing an input for a digital counter. A D.C. motor drive is used which is dynamically braked when a desired count is reached. A collector bin includes a detector for determining if the bin is empty to automatically initiate a new dispensing cycle, if desired.

22 Claims, 7 Drawing Sheets

CARD COUNTER AND DISPENSER

FIELD OF THE INVENTION

This invention relates to means for counting and dispensing cards from a stack of cards. Typically, such cards may be in the nature of lottery tickets with a multi-layered structure whereby they are moderately thick and heavy.

BACKGROUND OF INVENTION

Card handling machines are well known, particularly for use in feeding cards from a stack. Generally speaking, the mechanisms fall into two classes according to whether the cards are dispensed from the top or the bottom of a stack. In bottom faced dispensing arrangements which most closely relate to the instant invention, some type of motorized oscillating mechanism is provided for intermittently controlling the movement of the bottom card and/or the adjacent card to prevent the latter being entrained by the movement of the lowest card. Although reliable, these mechanisms are relatively slow and are more useful for feeding cards for printing operations or for dispensing a small number of cards. The mechanisms are usually complex and may add appreciably to the cost of the apparatus. Although the cost factor may not be a problem for large operations, for example those used for counting in excess of 50,000 cards/hour, there is a need for a fast, reliable, relatively low price apparatus for smaller operations.

Given that the cards being dispensed may be in the nature of lottery cards each having a significant value, there is a requirement for accuracy and reliability.

It is an object of this invention to provide a relatively high speed apparatus which is typically capable of counting and dispensing cards at a rate of up to 1000 cards/minute.

It is another object of this invention to provide such apparatus which is simple, reliable and uses few mechanically driven parts and which is of relatively low cost.

It is yet another object of this invention to provide such apparatus that counts and dispenses cards with accuracy.

In accordance with one aspect of this invention, apparatus for counting and dispensing cards from a stack of cards comprises feed means including a feed roll having an axis of rotation and a pair of nip rolls disposed forwardly thereof (the direction being taken relative to the direction of movement of the cards through the rolls) and a hopper disposed above the feed roll serving to orient the cards relative to the feed roll. The apparatus further comprises a gate which is suitably supported from the hopper, the gate having a progressively decreasing clearance from the peripheral surface of the feed roll in the forward direction, and means for adjusting the clearance between the gate and the feed roll.

Preferably, the hopper is adapted to feed the cards tangentially onto the feed roll, and still further it is preferred that the tangential point of contact between the cards and the feed roll be forward of the apogee of the feed roll. Accordingly, the cards will be somewhat downwardly inclined as they engage the feed roll. It is also preferred that the hopper be forwardly canted at or proximate the angle at which the cards are downwardly inclined.

The apparatus includes a chassis from which the rolls are supported. Conveniently, the gate is secured to the hopper, and the hopper is pivotally secured adjacent one lateral side thereof to the chassis, and means is provided for adjusting the angle at which the hopper is laterally inclined, so providing the gate clearance adjusting means.

Preferably, the gate is in the form of a doughnut like circular button having a rounded edge profile and a central axis through which the gate is mounted with its axis transverse to the axis of rotation of the feed roll. Also preferably, the gate is mounted whereby it is rotatable so as to compensate for wear.

The apparatus of the invention includes a drive means for driving the feed roll and the nip rolls, and suitably this will be arranged to drive the nip rolls at a higher peripheral speed than the feed roll. Accordingly, when a card is being moved under the influence of the nip rolls, it will advance more rapidly than an adjacent rearward card which is moving under the influence of the feed roll, and open a gap which facilitates the detection of the leading and trailing edges of cards by a photodetector, the signal from which is used for counting purposes. The gap also facilitates the collection of the cards in a collector bin. The cards are ejected more or less horizontally from the nip rolls at an appreciable velocity to impinge on an upstanding wall of the collector bin in which they are settled under the influence of a spring finger which is biased by the passage of a card through the nip rolls.

The invention will be described in relation to a preferred embodiment from which the foregoing objects and aspects, together with other objects and aspects will be apparent, taken in conjunction with the drawings annexed hereto.

DESCRIPTION OF THE PREFERRED EMBODIMENT

Figure 1:
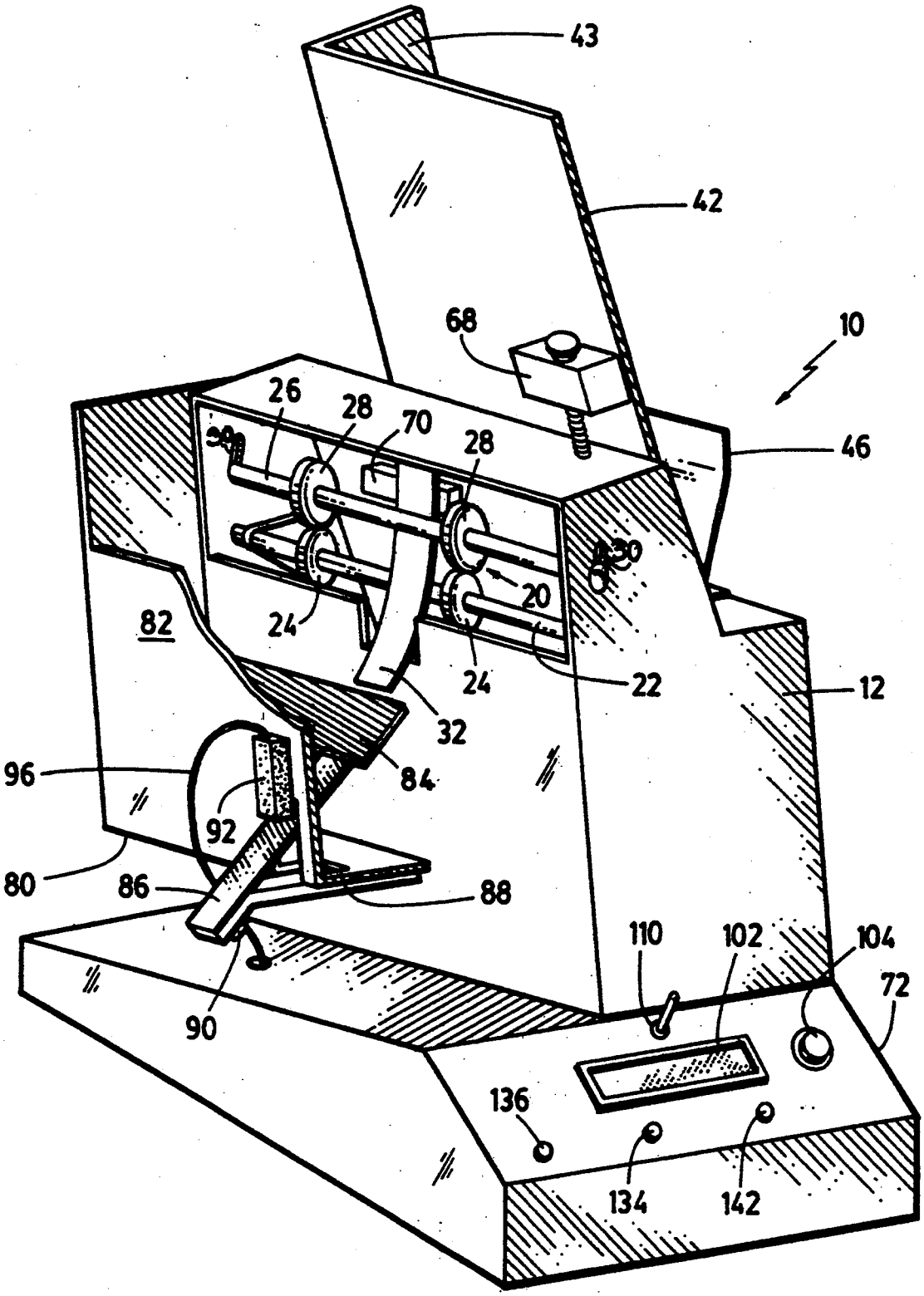
FIG. 1 shows in perspective view, a card counting and dispensing apparatus in accordance with my invention in perspective view from the front fight side thereof (the front to rear direction being defined by the direction of travel of the cards being dispensed)
Figure 2:
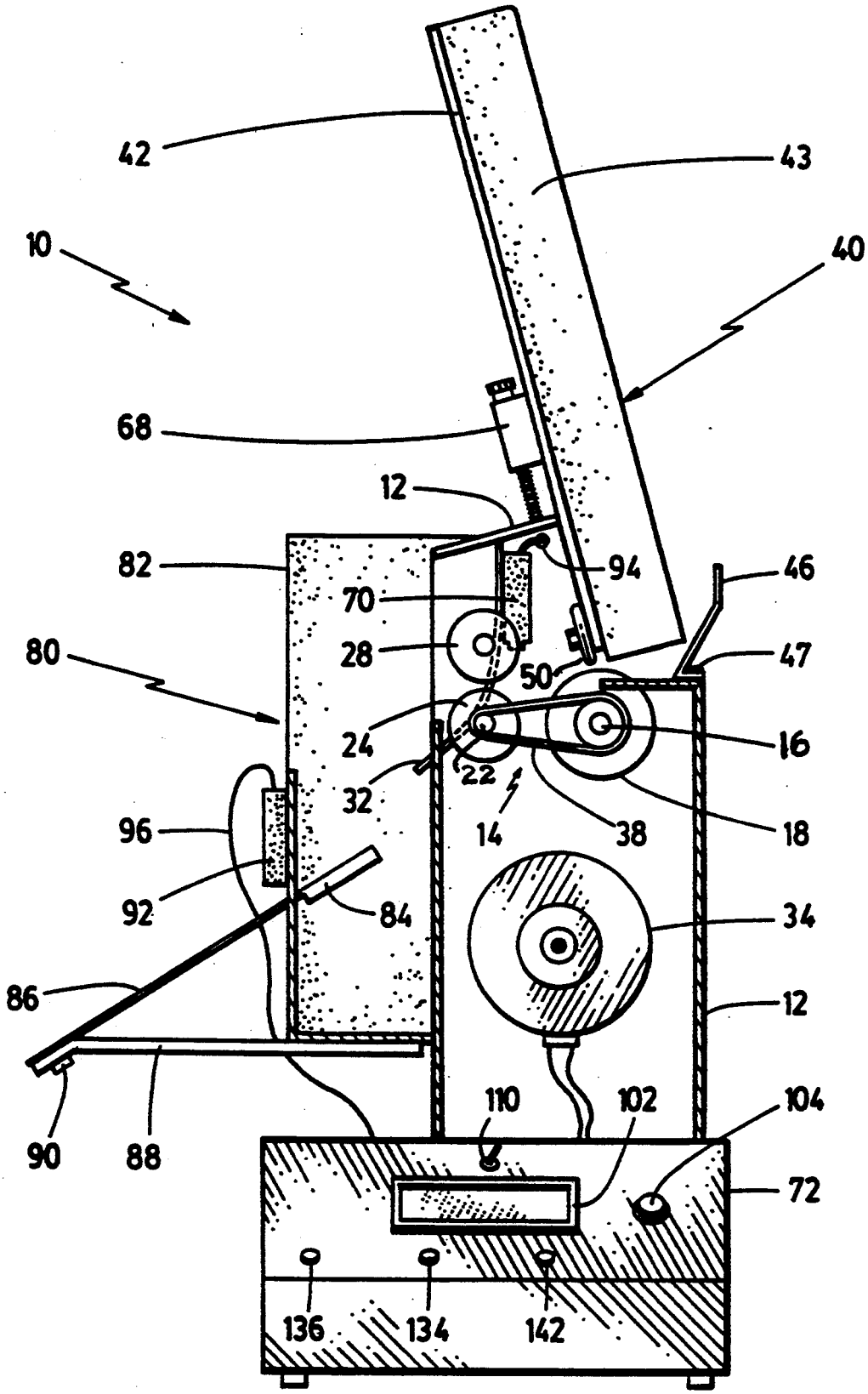
FIG. 2 shows the apparatus of FIG. 1 in fight side elevation with a fight side wall removed to reveal interior detail.
Figure 3:
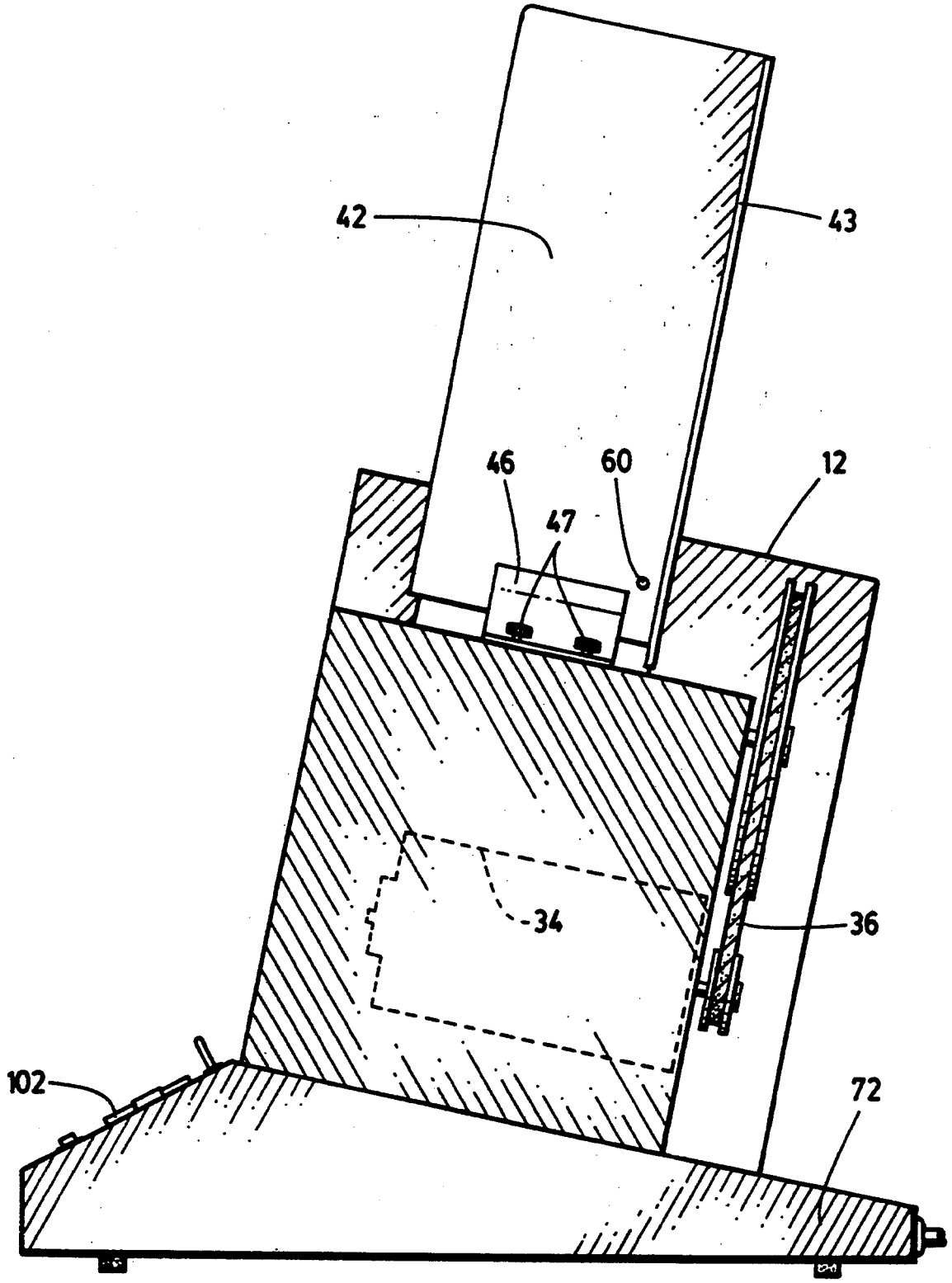
FIG. 3 shows the apparatus of FIG. 1 in rear elevation with a left side wall removed to reveal interior detail and other hidden detail shown in dashed outline.

Referring to the drawings in detail, the dispensing-/counting apparatus of the invention is denoted generally therein by the reference numeral 10.

Apparatus 10 comprises a chassis 12 from which there is mounted a card feed means 14, including a live axle 16, having a feed roll 18 secured thereto for rotation therewith, and nip rolls 20 comprising a lower live axle 22 on which there is mounted for rotation therewith a first pair of rolls 24, spaced apart so as to be respectively disposed on laterally opposed sides of feed roll 18, and an upper dead axle 26 on which there is rotatably mounted a second pair of rolls 28 in opposition to lower rolls 24. The nip of rolls 24, 28 is set by adjusting the movement of dead axle 26 along slotted openings 30. A flat spring finger 32 is secured at one end to chassis 12, intermediate portions of the spring passing under dead axle 26 and over live axle 22 to project therebelow.

Apparatus 10 includes a self braking DC drive motor, 34 which is made to stop within approximately a quarter-turn by the application of a dynamic brake on the removal of power, and which accelerates rapidly to maximum speed on the application of power. A 4:1 speed reduction is provided by a belt-pulley system 36 through which motor 34 drives live axle 22. A further belt-pulley system 38 interconnects live axle 22 to live axle 1.6 to drive feed roll 18 at a peripheral speed of about two thirds that of nip rolls 20.

Apparatus 10 also includes a feed hopper 40, comprising a major upstanding wall 42 and a side wall 43 which extends along one lateral side of wall 42 at right angles thereto. Hopper 40 is adapted and disposed relative to feed roll 18 so as to feed the lowest card from a stack of cards C located in the hopper tangentially onto the peripheral surface 44 of feed roll 18, forwardly of the apogee 45 of the feed roll. For this purpose, hopper 40 is forwardly canted at an angle $\alpha$ of about 15°, which additionally has the effect of urging the forward edge of cards C into contact with major wall 42 under the influence of gravity. Hopper 40 is also inclined upwardly outwardly, conveniently at an angle of about 15°, which has the effect of urging a side edge of cards C into contact with the side wall of the hopper under the influence of gravity.

Figure 4:
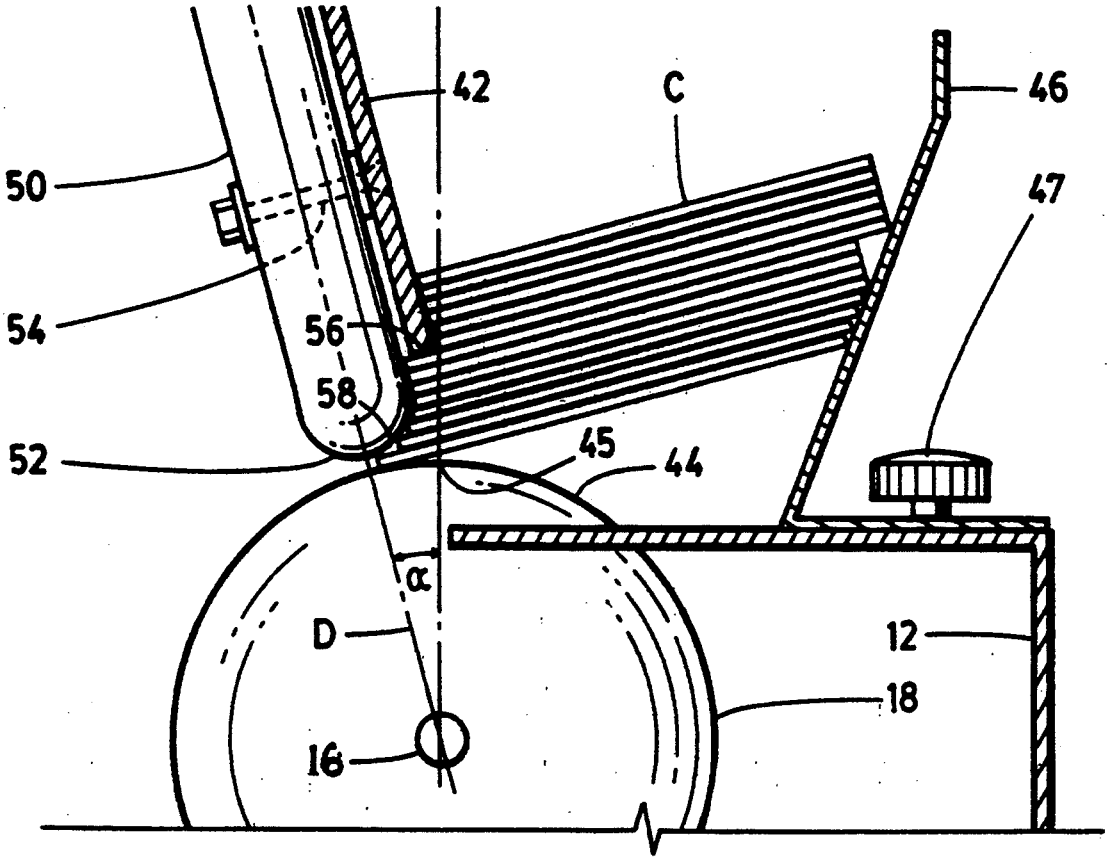
FIG. 4 shows detail of the feed hopper and feed mechanism in right side elevation on enlarged scale, with lower ones of a stack of cards in position in the feed hopper.
Figure 5:
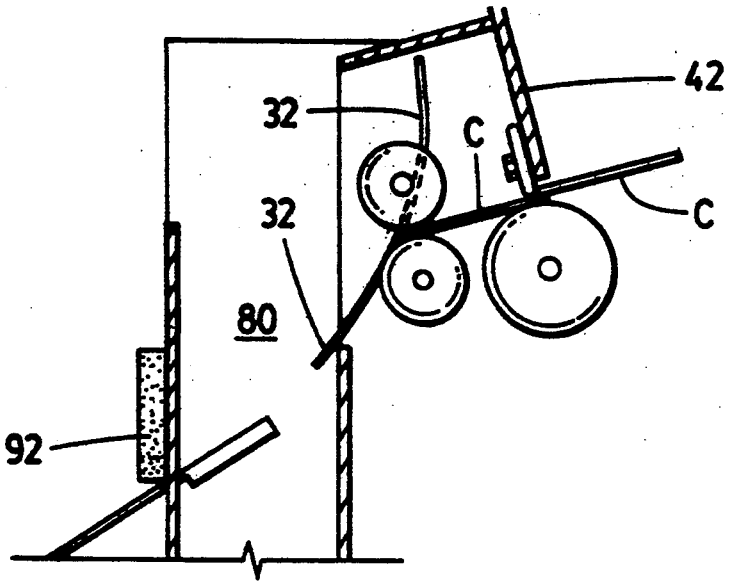
FIGS. 5–7 show in fight side elevation in somewhat schematic form, the passage of two successive cards being dispensed by the apparatus of FIG. 1.
Figure 6:
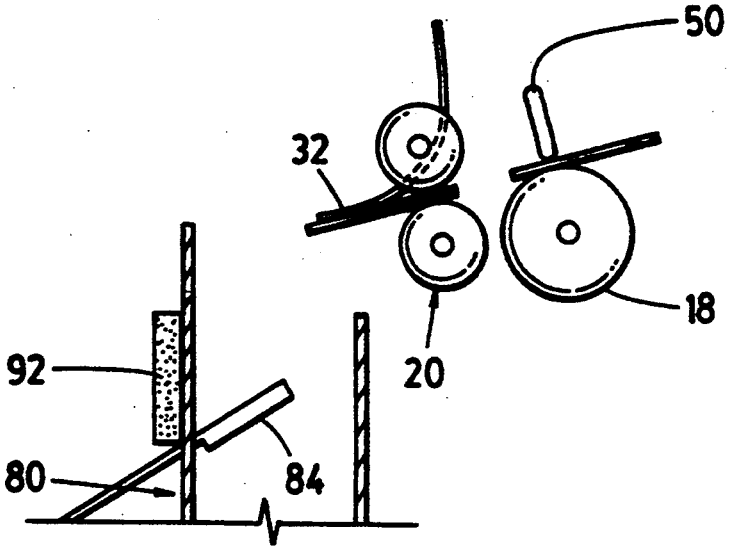
Figure 7:
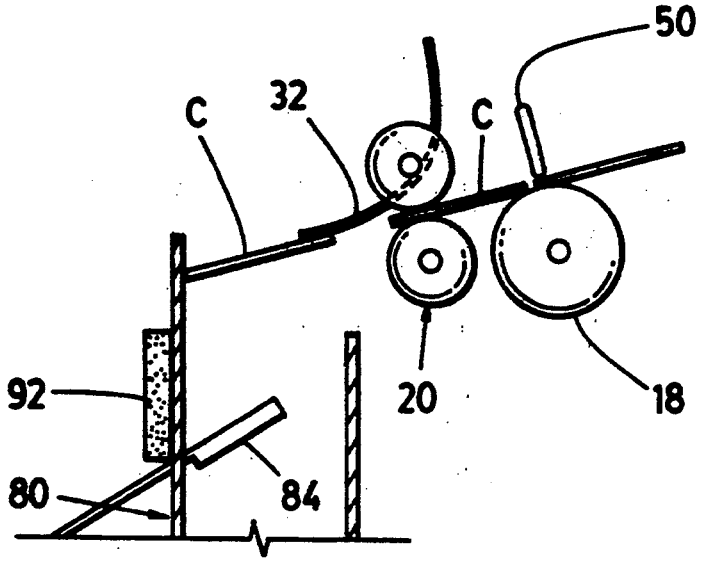
Figure 8:
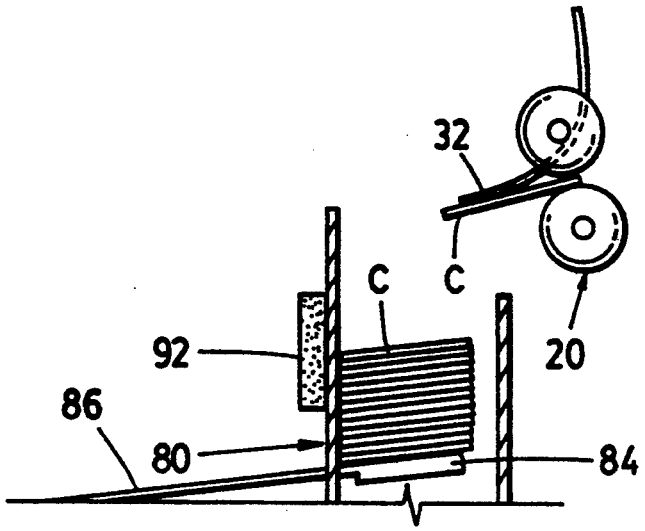
FIG. 8 is a schematic view of the collector bin from the fight side with a plurality of cards accumulated therein.

Hopper 40 includes a card support 46 for supporting rearward portions of the lowest one of the stack of cards C in approximately the desired tangential relationship with feed roll 18. Support 46 is suitably in the form of an upwardly rearwardly angled wall opposed to major wall 42, which forms a throat to support and urge the trailing edge of the lowest several cards progressively forwardly into contact with a gate 50 which is disposed forwardly of hopper 40, this action best being seen in FIG. 4. In the event that apparatus 10 is to be used with stacks of different widths of cards C, provision is made for adjusting the spacing of support 46 from major wall 42 by the use of thumb screws 47.

Gate 50 is in the form of a doughnut like circular disk having a rounded edge profile 52 and a central axis 54 through which the gate is mounted to major wall 42 externally of feed hopper 40, so as to project below the lower edge 56 of major wall 42. The perigee 58 of gate 50 is disposed in spaced apart opposed relationship to the peripheral surface 44 of feed roll 18 in the plane of a diameter D of feed roll 18, canted at the angle of cant $\alpha$ of hopper 40. Major wall 42 of hopper 40 is mounted from chassis 12 by a hinge pivot 60 which passes through major wall 42 adjacent side wall 43, and by a screw adjusting mechanism 68 disposed on major wall 42 externally of hopper 40, which thereby provides a simple means of adjusting the gap between gate 50 and the peripheral surface 44 of feed roll 18. A photodetector cell 70 is disposed intermediate gate 50 and nip rolls 20, and is suitably mounted from the proximal end of spring 32.

Chassis 12 and the various components mounted therefrom as hereinbefore described are generally constructed so as to be in rectilinear relationship other than in respect of major wall 42 of hopper 40 which is supported from chassis 12 in forwardly canted relationship. Chassis 12 is conveniently mounted from the cover of a housing 72 which slopes downwardly towards the left side of the apparatus at an angle of about 15°, thus serving to incline the hopper towards side wall 43 for the above mentioned purpose.

Apparatus 10 further includes an open-fronted collector bin 80 mounted from chassis 12 adjacently forward of nip rolls 20. Bin 80 comprises an upstanding major wall 82, contained in a vertical plane parallel to axle 16, and a floor 84 which is movingly supported by relatively long leaf spring 86 attached to fixed support arm 88. An adjusting screw 90 is provided on support arm 88 to regulate the spring pressure exerted on floor 84 by leaf spring 86, and thereby control the deflection of the spring and the floor therewith under the influence of cards delivered to bin 80 from the feed means 14. A proximity switch 92 is mounted on wall 82 externally of bin 80 in a position whereby it is toggled to a first condition by the proximity of leaf spring 86 when no card C is present in bin 80, and to a second condition when spring 86 is deflected under the influence of one or more cards supported on floor 84.

Considering now the operation of apparatus 10 as thus far described, prior to the dispensing and counting of cards using the apparatus, throat wall support 46 is adjusted using thumb screws 47 so that the lowest card C positioned in hopper 40 will be forwardly, downwardly angled towards the peripheral surface 80 of feed roll 18, and be more or less tangential thereto when the forward edge of the card is adjacent the perigee 58 of gate 50. The clearance of gate 50 is adjusted using screw adjusting mechanism 68 so that a card when angled in this manner will just pass between the gate and feed roll 18.

With apparatus 10 adjusted in this manner, a stack of cards C to be counted and dispensed is placed in hopper 40 with two edges of the cards respectively adjacent major wall 42 and side wall 43, and the inclination of these walls will urge the cards towards the walls under the influence of gravity. As will be best appreciated from a consideration of FIG. 4, the gravitational force on cards C in hopper 40 that is engendered by the forward canting of major wall 42 and by the inclination and spacing of throat wall support 46, together with the forward movement of the lowest card under the influence of feed roll 18, urge the lowest several cards forwardly into abutment with gate 50. The rounded edge profile 52 of gate 50 serves to position the leading edge of the lowest several cards C progressively forwardly, so that the penultimate card is positioned to make good contact with feed roll 18 as soon as the lowest card is withdrawn from the hopper 40, but not before and also provide a resultant downward force on the leading edge of the lowest several cards. The rotation of feed roll 18 urges the lowest card C forwardly towards nip rolls 20 at the peripheral speed of feed roll 18. As the leading edge of the first card passes beneath photodetector cell 70, this will generate a change of state in the detector cell which is carded on conductors 94 for processing as will be later described. The card C is accelerated in nip rolls 20, thereby creating a gap between the trailing edge of a first card passing through the nip rolls and the leading edge of the next card as it urged forwardly by the feed roll, which gap is at a maximum as the trailing edge of the first card is ejected from the nip rolls 20. Accordingly, photodetector cell 70 is desirably located between the feed roll 18 and nip rolls 20 somewhat closer to the entrance to the nip rolls than to the exit from the feed roll, in order to facilitate the detection of the trailing and leading edges of successive cards by the photodetector cell.

As a card C moves through nip rolls 20, the distal end of spring finger 32 is upwardly biased by contact with the card. Card C is typically expelled from the nip rolls 20 at a velocity of about 50 cms/sec, which is sufficient to project the card a short distance until the leading edge thereof strikes wall 82 of bin 80, thereby arresting further movement of the card, which, under the influence of upwardly biased spring finger 32, will be urged downwardly to fall a small distance and settle on floor 84. Assuming that this is the first card dispensed into bin 80, proximity switch 92 will be tripped and the output therefrom on conductors 96 will be used for detecting the presence or absence of a card in bin 80, as will be subsequently described.

Figure 9:
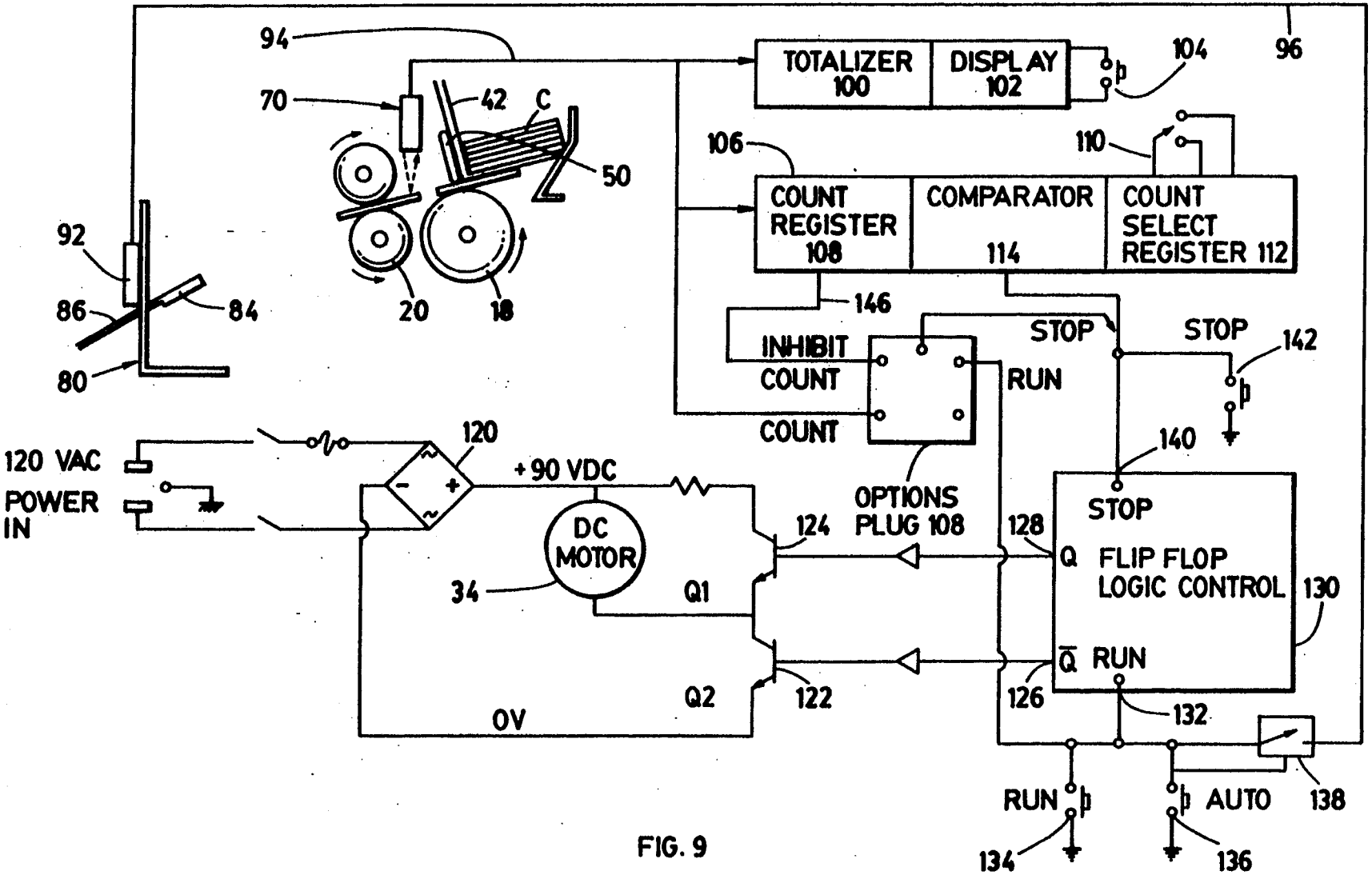
FIG. 9 is a schematic of the electrical and electronic arrangements used in the apparatus of the invention.

With reference to FIG. 9, apparatus 10 further comprises a totalizer 100, which increments by one on the receipt of a pulse transmitted on conductors 94 from photodetector cell 70, on the detection of the trailing edge of a card C, and a display 102 which displays the total count. Totalizer 100 may be reset to zero by means of a reset switch 104. Conductors 94 also connect to a counter unit 106, which includes a count select register 108 actuated by set count switch 110, a count register 112 and a comparator 114. Typically count select switch 110 may include presettable positions for requesting the dispensing of preset numbers of cards C, for example twenty five, fifty or one hundred, or it may include means for setting any desired number of cards to be counted.

Power for driving DC motor 34 is derived from a bridge rectifier 120. Motor 34 is switched between a drive state and a dynamic brake state by means of power transistors 122, 124, which are respectively connected to the outputs 126, 128 of flip-flop 130 for control thereby such that when power transistor 122 is conditioned to an ON state, power transistor 124 will be conditioned OFF and vice versa. Power transistor 122 is conditioned ON by the receipt of a momentary input at RUN terminal 132 of flip-flop 130, which may arise from actuation of a momentary contact run switch 134 or auto switch 136, both of which are mounted from housing 72. The actuation of autoswitch 136 further serves to latch self latching switch 138 to an ON condition, which connects RUN terminal 132 to proximity switch 92 via conductors 96. Accordingly, each time that bin 80 is emptied, a RUN signal will be generated by proximity switch 92 and an input to RUN terminal 132, so providing for the automatic replenishment of bin 80.

Power transistor 124 is conditioned ON by the receipt of a momentary signal received at STOP terminal 140 of flip flop 130, which may arise from the actuation of a momentary contact stop switch 142, or a signal output from comparator 114 when the value of count register 108 is equal to that of count select register 112. An options plug 144 permits the external control of apparatus 10, for example by inhibiting count register 108 by a signal on conductor 146, and generating Run and Stop signals as appropriate.

The foregoing objects and aspects of the invention, together with other objects, aspects and advantages thereof will be more apparent from a consideration of the following description of the preferred embodiment thereof taken in conjunction with the drawings annexed hereto.

I claim:

1. Apparatus for counting and dispensing cards from a stack of cards comprising:

a chassis;

feed means comprising a feed roll having an axis of rotation mounted from said chassis in a fixed position and a peripheral surface, and a pair of nip rolls disposed forwardly of said feed roll for receiving cards from said feed roll;

drive means for driving said feed means;

a hopper for holding a stack of cards;

said hopper including a major wall surface serving to orient said cards with an edge parallel to said axis of rotation;

said major wall surface having a lower terminating edge;

a circular gate disposed forwardly of said major wall surface to project below said terminating edge;

said gate having a central axis disposed approximately at right angles to the axis of rotation of said feed roll;

said gate providing a progressively decreasing clearance from said peripheral surface in the forward direction; and means for adjusting the clearance between said gate and said surface of said feed roll.

2. An apparatus as defined in claim 1 wherein said hopper includes a support for supporting at least the lowest one of a stack of cards when contained in said hopper.

3. An apparatus as defined in claim 2 wherein said support comprises an upwardly, rearwardly inclined wall.

4. An apparatus as defined in claim 1 wherein said hopper is adapted to feed said cards tangentially onto said feed roll.

5. An apparatus as defined in claim 1 wherein said hopper is adapted to feed said cards tangentially onto said feed roll forwardly of the apogee of said feed roll.

6. An apparatus as defined in claim 5 wherein said gate is doughnut shaped.

7. An apparatus as defined in claim 6 wherein the perigee of said gate is disposed in a diametric plane of said feed roll.

8. An apparatus as defined in claim 6 wherein said gate is mounted for rotation about its circular axis.

9. An apparatus as defined in claim 6 wherein said gate is mounted from said major wall.

10. An apparatus as defined in claim 9 wherein said clearance adjusting means includes a hinge pivotally mounting said hopper to said chassis, and means for adjusting the angle at which said hopper is pivoted about said hinge.

11. An apparatus as defined in claim 1 wherein said hopper includes a side wall serving to orient a lateral edge portion of said cards, and wherein said hopper is laterally inclined at a small angle to the vertical to urge said lateral edge portion of said cards into contact with said side wall.

12. An apparatus as defined in claim 11 wherein said axis of rotation is laterally inclined at approximately the same angle of lateral inclination as said hopper.

13. An apparatus as defined in claim 1 wherein said drive means drives said nip rolls at a faster peripheral speed than said feed roll to provide a gap between the trailing edge of a card moving under the influence of said nip rolls and the leading edge of a card moving under the influence of said feed roll.

14. An apparatus as defined in claim 13 including photodetector means disposed to detect the leading edge and the trailing edge of a card when passing through said feed means.

15. An apparatus as defined in claim 14 wherein said photodetector means is disposed intermediate said feed roll and said nip rolls.

16. An apparatus as defined in claim 1 including a bin disposed forwardly of said nip rolls for collecting cards discharged from said nip rolls.

17. An apparatus as defined in claim 16 including a downwardly directed spring finger which is disposed to be upwardly biased by a card moving under the influence of said nip rolls and which urges said card downwardly into said bin as said card is discharged from said nip rolls.

18. In an apparatus for counting and dispensing cards from a stack of cards comprising:

a chassis;

a feed means comprising a feed roll having an axis of rotation mounted from said chassis in a fixed position and a peripheral surface, and a pair of nip rolls disposed forwardly of said feed roll for receiving cards from said feed roll;

drive means for driving said feed means;

a hopper for holding a stack of cards;

gate means for feeding cards from said stack of cards in said hopper to said feed roll;

a bin disposed forwardly of said nip rolls for collecting cards discharged from said nip rolls; the improvement wherein said bin includes a floor and spring means mounting said floor for depression under the influence of cards collected in said bin.

19. An apparatus as defined in claim 18 wherein detector means is provided for determining whether said bin is empty or not empty.

20. An apparatus as defined in claim 1 including digital means to preset a number of cards to be counted and for storing said number in a register;

means for counting cards dispensed from said feed roll and comparing the number of dispensed cards with said preset number of cards; and means for stopping said drive means when the number of dispensed cards is equal to the preset number of cards.

21. An apparatus as defined in claim 20 including bin means for collecting cards dispensed, and a switch means associated with said bin means for resetting the preset number of cards to be counted when said bin means is emptied.

22. In an apparatus for counting and dispensing cards from a stack of cards comprising:

a chassis;

feed means comprising a feed roll having an axis of rotation mounted from said chassis in a fixed position and a peripheral surface, and a pair of nip rolls disposed forwardly of said feed roll for receiving cards from said feed roll;

drive means for driving said feed means;

a hopper for holding a stack of cards;

gate means mounted from said hopper in relationship with said feed roll;

a bin disposed forwardly of said nip mils for collecting cards discharged from said nip rolls;

the improvement wherein said hopper is pivotally mounted to said chassis by a hinge means and wherein adjustment means is provided for adjusting the angle at which said hopper is pivoted about said hinge means and thereby vary the gap between said gate means and said feed roll.

* * * * *